United States Patent [19]

Ouchi et al.

[11] 4,329,172

[45] May 11, 1982

[54] HIGH MANGANESE NONMAGNETIC STEEL HAVING EXCELLENT MACHINABILITY

[75] Inventors: Chiaki Ouchi, Yokohama; Tetsuya Sampei, Kawasaki, both of Japan

[73] Assignee: Nippon Kokan Kabushiki Kaisha, Tokyo, Japan

[21] Appl. No.: 220,363

[22] Filed: Dec. 29, 1980

[30] Foreign Application Priority Data

Jan. 8, 1980 [JP] Japan ..... 55-697

[51] Int. Cl.[3] ..... C22C 38/06

[52] U.S. Cl. ..... 75/124; 75/123 N; 75/126 B

[58] Field of Search ..... 75/124 C, 123 G, 123 N, 75/123 J, 123 L, 126 B, 126 E, 126 L, 126 Q

[56] References Cited

U.S. PATENT DOCUMENTS

| | | | |
|---|---|---|---|
| 2,157,146 | 5/1939 | Riedrich | 75/123 L |
| 4,004,922 | 1/1977 | Thiveller et al. | 75/123 G |
| 4,240,827 | 12/1980 | Aihara et al. | 75/126 L |
| 4,256,516 | 3/1981 | Ouchi et al. | 75/123 N |

FOREIGN PATENT DOCUMENTS

| | | |
|---|---|---|
| 52-36513 | 3/1977 | Japan . |
| 54-81119 | 6/1979 | Japan . |

*Primary Examiner*—John P. Sheehan

*Attorney, Agent, or Firm*—Frishauf, Holtz, Goodman & Woodward

[57] ABSTRACT

The nonmagnetic alloy consists of 0.22–0.30% by weight of carbon, 22–28% by weight of manganese, up to 4% by weight of silicon, 0.030–0.10% by weight of sulphur, 0.001–0.008% by weight of calcium, 0.001–0.008% by weight of sol.Al and the balance of iron. If desired, either one or both of up to 2.0% by weight of chromium and up to 2.0% by weight of vanadium may be incorporated.

2 Claims, 7 Drawing Figures

0.25C−25Mn
●: S
○: S
SAMPLE-A
SAMPLE-C
SAMPLE-E
SAMPLE-B
SAMPLE-D
(TOOL LIFE OF SUS 303)
SAMPLE-7
SAMPLE-6
SAMPLE-4
SAMPLE-3
TOOL LIFE AT CUTTING SPEED OF 150 m/min
KT=50 (min)
S (%)
0
0.05
0.100
0.150
100
50
40
30
20
10
5
4
3
2
1

SAMPLES OF THE INVENTION SUBJECTED TO CaS TREATMENT 0.25C−25Mn−CaS
S 0.053~0.060
SAMPLE-A
SAMPLE-D
SAMPLE-E
SAMPLE-C
SAMPLE-B
CONTROL SAMPLE-8
TOOL LIFE AT CUTTING SPEED OF 150 m/min
KT=50 (min)
Sol Al (%)
0
0.005
0.010
0.015
100
50
40
30
20
10
5
4
3
2
1

HIGH MANGANESE NONMAGNETIC STEEL HAVING EXCELLENT MACHINABILITY

BACKGROUND OF THE INVENTION

This invention relates to a high manganese nonmagnetic steel having excellent machinability.

Many attempts have been tried to improve the machinability of high manganese nonmagnetic steel. For example, to improve the machinability, it has been proposed to incorporate into high manganese nonmagnetic steel one or more of the elements of S, Se, Te, and Pb, which are considered as effective to improve the machinability when incorporated into ordinary steel, or a suitable amount of sulphur, which is considered as effective when incorporated into steel having the deoxidation effect adjusted by incorporation of Ca (See for example Japanese laid open patent specification Nos. 81119/1979 and 36513/1977). With these methods, the machinability can be improved to some extent depending upon the quantity of the elements incorporated but these methods can not completely solve the problem of greatly improving the machinability.

SUMMARY OF THE INVENTION

It is an object of this invention to provide high manganese nonmagnetic steel having high machinability.

Another object of this invention is to provide high manganese nonmagnetic steel which can maintain its stable austenite structure during the cutting operation.

Still another object of this invention is to lengthen the life of tool for use in cutting high manganese nonmagnetic steels.

According to this invention there is provided high manganese nonmagnetic steel consisting of 0.22–0.30% by weight of carbon, 22–28% by weight of manganese, up to 4% by weight of silicon, 0.030–0.10% by weight of sulphur, 0.001–0.008% by weight of calcium, 0.001–0.008% by weight of sol.Al and the balance of iron.

If desired, either one or both of up to 2.0% by weight of chromium and up to 2.0% by weight of vanadium may be incorporated.

BRIEF DESCRIPTION OF THE DRAWINGS

Other objects and the advantages of the invention can be more fully understood from the following detailed description taken into conjunction with the accompanying drawings in which.

DESCRIPTION OF THE PREFERRED EMBODIMENTS

Figure 1:
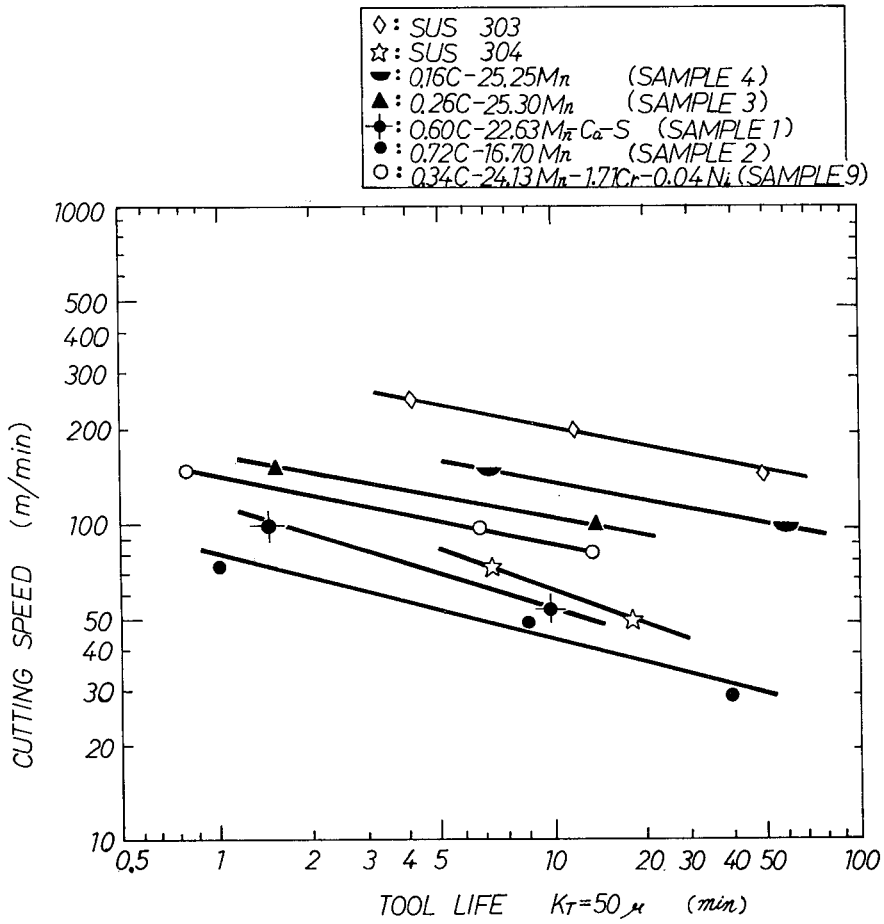
FIG. 1 is a graph showing the influence of the quantities of carbon and manganese upon V-T (cutting speed—tool life) characteristics of cemented carbide tools.

The inventors have found that the poor machinability of the conventional high manganese nonmagnetic steel having high hardness is caused by the fact that it contains carbon in an amount higher than 0.35% by weight (for brevity, hereinafter all % are weight % unless otherwsie specified), that carbides precipitate as the temperature rises as a result of a cutting operation (carbides partly precipitate even in the as rolled state), and that during the cutting operation the portion being cut or a nearby portion is transferred into a martensite structure. According to this invention, carbon content is selected in the range of 0.22 to 0.30% which is lower than the carbon content of the prior art high manganese nonmagnetic steel. This not only decrease the hardness to improve the machinability but also prevents precipitation of carbides during cutting or in an as rolled state.

Furthermore, the tendency of the austenite structure to become unstable, which would be caused by the decrease in the carbon content, can be prevented by using a suitable quantity of manganese with the result that even under such heavy reduction rate in cold working as 80% a stable austenite structure can be maintained. Consequently, it is possible to prevent the portion being cut or nearby portion from transforming into martensite. Although the ranges of the content of sulphur of 0.030–0.10% and calcium of 0.001–0.008% are the same as those utilized in the prior art to improve the machinability, mere application of this condition to the prior art high manganese nonmagnetic steel results in a slight improvement of the machinability. Only by selecting the contents of C, Mn, Si, Al, S and Ca in the specified ranges, the machinability can be greatly improved.

More particularly, the percentages of respective ingredients are selected for the following reasons:

With less than 0.22% of carbon, the cutting chips are difficult to break up, and the strength becomes too low (yield strength of less than 25 kg/mm$^2$). When the quantity of carbon exceeds 0.30% the tensile strength and the hardness become too high and the precipitation of a large amount of carbides much occurs so that the machinability degrades.

The presence of manganese is effective to maintain a stable austenite structure during cutting. Especially, in this invention the quantity of manganese should be higher than that used in the prior art high manganese nonmagnetic steel in view of the fact that the low carbon content tends to make the austenite structure unstable. For this reason, the manganese content should be at least 22%. With lesser quantity of manganese the austenite transforms to martensite structure during cutting. Although as the content of manganese is increased the austenite structure becomes stable, incorporation of manganese in excess of 28% results in an increase of the manufacturing cost. It was found the quantity of manganese in a range of 22–28% is sufficient.

Usually, less than 0.8% of silicon is incorporated as a deoxidizing agent, but it may be incorporated in an amount of up to 4% for the purpose of improving the yield strength. Incorporation of silicon of more than 4% does not cause a more advantageous effect but increases the manufacturing cost.

Aluminum is an indispensable element for deoxidation and fixing nitrogen and sol.Al is added in an amount of 0.001% at least. However, when the quantity of sol.Al exceeds 0.008% hard $Al_2O_3$ would remain in the steel causing scratches and abrasions to be formed on the surface of the cutting tool. For this reason, the maximum content of sol.Al should be 0.008%.

Calcium and sulphur have the same effect as in the ordinary CaS free cutting steel. In this invention, these elements are used in similar ranges. More particularly, sulphur of less than 0.03% can not give the desired effect but incorporation of sulphur in excess of 0.10% forms cracks in the product thus decreasing the yield. Calcium is incorporated for adjusting the deoxidation effect and for alleviating the adverse effect of $Al_2O_3$ so that when calcium is incorporated together with sulphur, the machinability is improved. When high speed cutting with a cemented carbide tool is applied to sulphur free cutting steel crater wear ($K_T$) advances rapidly, but calcium is incorporated together with sulphur in this invention so that the function of crater wear can be reduced greatly. 0.001% is the minimum quantity of calcium necessary to provide these advantageous effects.

The following Table 1 shows chemical compositions of the samples of nonmagnetic steel embodying the invention and control samples.

TABLE 1

| | STEEL | C | Si | Mn | P | S | Cu | Ni | Cr | Mo | Ca | sol Al |
|---|---|---|---|---|---|---|---|---|---|---|---|---|
| CONTROL | SUS304 | 0.039 | 0.43 | 0.39 | 0.028 | 0.011 | 0.12 | 8.03 | 18.34 | 0.20 | | 0.001 |
| | SUS303 | 0.039 | 0.44 | 1.46 | 0.036 | 0.196 | 0.12 | 7.94 | 17.09 | 0.46 | | 0.001 |
| | 1 | 0.60 | 0.56 | 22.63 | 0.013 | 0.044 | | | 5.51 | tr | 0.0012 | 0.003 |
| | 2 | 0.72 | 0.17 | 16.70 | 0.011 | 0.004 | | | | | | 0.006 |
| | 3 | 0.26 | 0.22 | 25.30 | 0.009 | 0.004 | | | | | | 0.003 |
| | 4 | 0.16 | 0.20 | 25.25 | 0.008 | 0.018 | | | | | | 0.005 |
| | 5 | 0.012 | 0.15 | 35.08 | 0.010 | 0.004 | | | | | | 0.001 |
| | 6 | 0.25 | 0.23 | 25.80 | 0.007 | 0.046 | | | | | | 0.006 |
| | 7 | 0.24 | 0.29 | 24.49 | 0.008 | 0.078 | | | | | | 0.002 |
| | 8 | 0.25 | 0.24 | 25.00 | 0.009 | 0.060 | | | | | 0.0036 | 0.010 |
| | 9 | 0.34 | 0.40 | 24.13 | 0.028 | 0.003 | 0.016 | 0.04 | 1.71 | | | 0.001 |
| THIS INVEN-TION | A | 0.25 | 0.21 | 25.39 | 0.007 | 0.053 | | | | | 0.0040 | 0.002 |
| | B | 0.25 | 0.18 | 26.50 | 0.009 | 0.054 | | | | | 0.0040 | 0.008 |
| | C | 0.25 | 0.23 | 24.58 | 0.010 | 0.060 | | | 1.75 | | 0.0032 | 0.006 |
| | D | 0.26 | 0.11 | 27.05 | 0.011 | 0.064 | | | | V: 1.02 | 0.0066 | 0.005 |
| | E | 0.24 | 2.75 | 27.50 | 0.011 | 0.088 | | | | | 0.0028 | 0.003 |

These steels were cut under the conditions shown in the following Table 2 by using cemented carbide tools and high speed steel tools respectively.

TABLE 2

| | cemented carbide tool | high speed steel tool |
|---|---|---|
| tool material | STi20 (corr. to P20) manufactured by Mitsubishi Kinzoku Kogyo Co. Ltd. | NK4 (corr. to SKH4) manufactured by Nippon Koshuha Kogyo Co. Ltd. |
| identification of inserts | TPN331 | TPN321 |
| cutting edge shape | (−6,−6,6,6,30,0,0.4) | (0,5,11,6,30,0,0.4) |
| bite protrusion | 40 mm | 40 mm |
| chip breaker width | 2.5 mm | 2.5 mm |
| cutting depth | 2.0 mm | 1.0 mm |
| feed | 0.20 mm/rev | 0.05 mm/rev |
| cutting speed | 30–250 m/min | 20–40 m/min |
| tool life criterion | KT = 50 μ | perfectly worn out |

Figure 7:
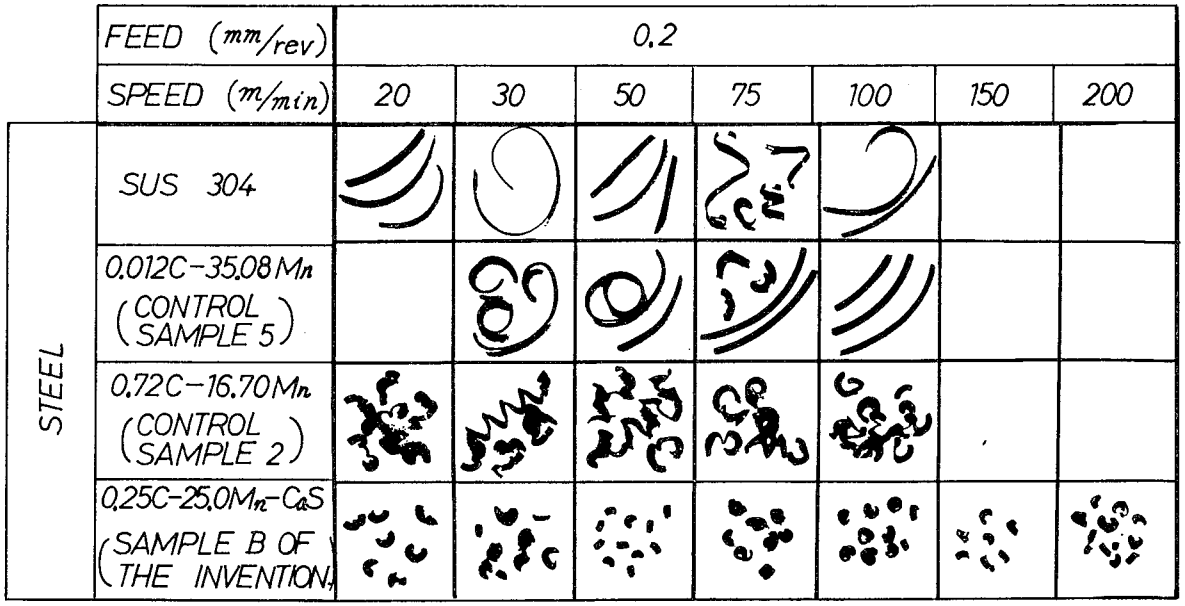
FIG. 7 shows photographs of chips disposability comparing one sample of the nonmagnetic steel embodying the invention and a control steel.

FIG. 1 is a graph showing the relationship (V-T curve) between the cutting speed (ordinate) and the tool life (abscissa) and comparing SUS303 (high speed cutting stainless steel) and SUS304 with control samples 1 to 4 and 9 shown in Table 1. Control samples 2 to 4 were not subjected to a CaS treatment, that is do not satisfy the contents of sulphur and calcium described above. Strictly speaking, in control samples 2 and 4 the quantity of carbon is also on the outside of the range of this invention. Curves shown in FIG. 1 show variation in the machinability caused by a ratio between carbon and manganese. FIG. 1 clearly shows that the machinability can be greatly improved by decreasing the quantity of carbon and by increasing the quantity of manganese which constitutes the essential feature of this invention. Where the quantity of carbon is high, even when the steel is subjected to a CaS treatment which has been considered to improve the machinability at the time of high speed cutting, as shown by the control sample 1, the machinability is much inferior than that of SUS304. In other words, by decreasing the quantity of carbon and by increasing the quantity of manganese, the machinability can be improved without CaS treatment. However, a too low quantity of carbon impairs chips disposability. In other words, chips would have the same high viscosity as SUS304 shown by control sample 5 regarding the shape of the chips as shown in FIG. 7. It can be noted that where the ratio of carbon and manganese is selected in a range specified in this invention, it becomes possible to lower the hardness, prevent the precipitation of carbides and maintain a stable austenite structure during cutting thereby improving the machinability to some extent. However, comparison of SUS303 with control sample 3 shows that the significant improvement of the machinability can not attained by satisfying only the specified ranges of carbon and manganese contents.

Figure 2:
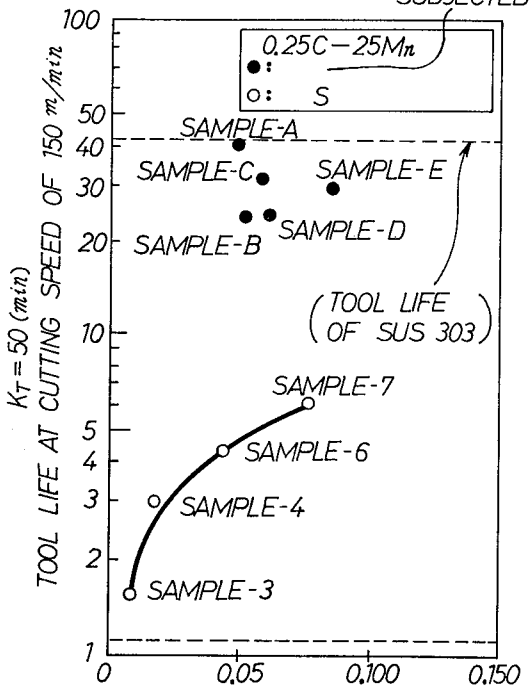
FIG. 2 is a graph showing the influence of S and CaS treatments upon the life of cemented carbide tools.

S and CaS treatments are applied to steel containing C and Mn in quantities within our specified ranges, the results of which are shown in FIG. 2. More particularly, as quantity of sulphur incorporated is increased the machinability is improved and the samples A through E of the invention into which calcium is incorporated together with sulphur show excellent machinability compared with that of SUS303.

Figure 3:
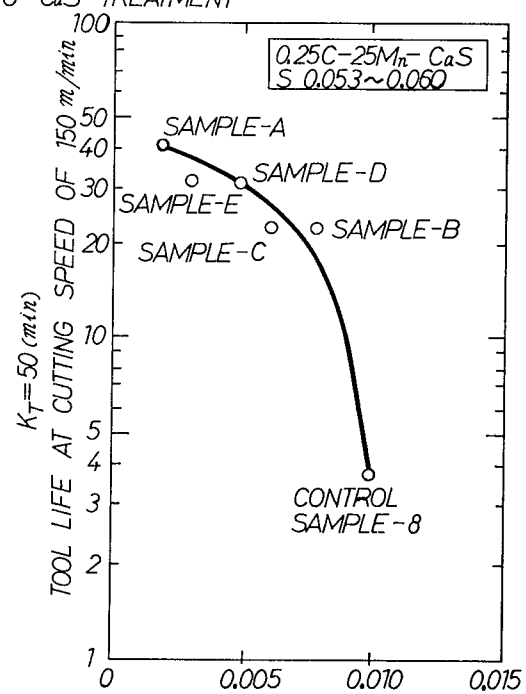
FIG. 3 is a graph showing the effect of the quantity of sol.Al upon the life of cemented carbide tools where the cemented carbide tools are used for cutting nonmagnetic steel consisting of C, Mn, S and Ca in quantities specified by the invention.

To realize such advantageous effect of the CaS treatment, it is essential to limit the quantity of sol.Al in a range from 0.001–0.008%. FIG. 3 shows the relationship between sol.Al content and the tool life at a cutting speed of 150 m/min on condition that C, Mn, Ca and S are contained in quantities within our claimed ranges. As shown, the control sample 8 containing sol.Al in excess of 0.008% does not show the advantage of the calcium treatment. More particularly, this control sample shows the same degree of the machinability as steel containing the same quantity of sulphur but being not subjected to the Ca treatment, whereas in the samples A through E of this invention containing less than 0.008% of sol.Al the effect of CaS treatment is significant.

Figure 4:
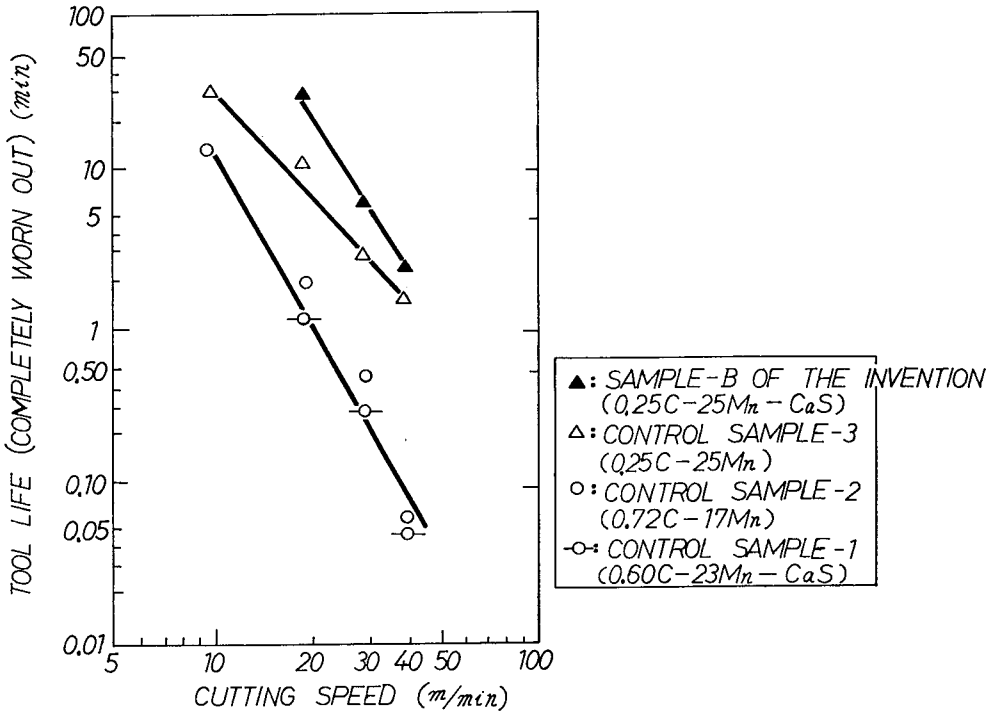
FIG. 4 is a graph showing the influence of the ratio of C and Mn upon the life of high speed steel tools.

As above described, in case of cutting with cemented carbide tools the machinability of high manganese nonmagnetic steel of this invention is improved especially by selecting a proper selection of carbon and manganese quantities. This advantageous effect of this invention is remarkably shown in case of cutting with high speed steel tools as shown in FIG. 4. More particularly, as shown by the control sample 2, when carbon content is too high and manganese content is too low, that is do not satisfy the essential feature of the invention, the CaS treatment is not effective because of high hardness and much precipitation of carbides. On the other hand, by limiting the quantities of carbon and manganese in the ranges recited in the claim, the life of the tool is lengthened and the effect of the CaS treatment can be obtained remarkably. The machinability of high manganese nonmagnetic steel of the invention when cut with high speed steel tools is much superior than that of the prior art. Since high speed steel tools are widely used for sawing, drilling and tapping, for example, this advantageous effect is remarkable and essential.

Figure 5:
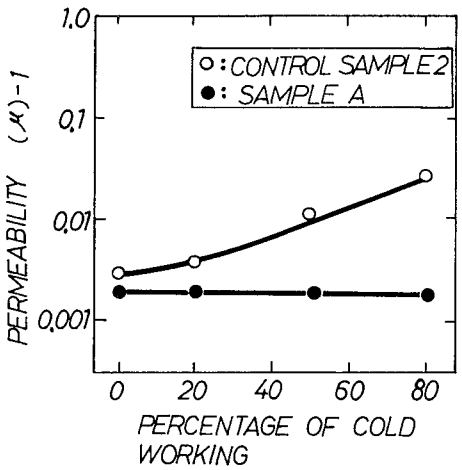
FIG. 5 is a graph showing the relationship between the percentage of cold working and permeability.

FIG. 5 is a graph showing the relationship between the permeability of the steel and the percentage of cold rolling reduction. In steel of this invention containing carbon and manganese in the predetermined ranges the permeability is substantially constant, e.g. 0.002, showing a stable austenite structure.

Figure 6:
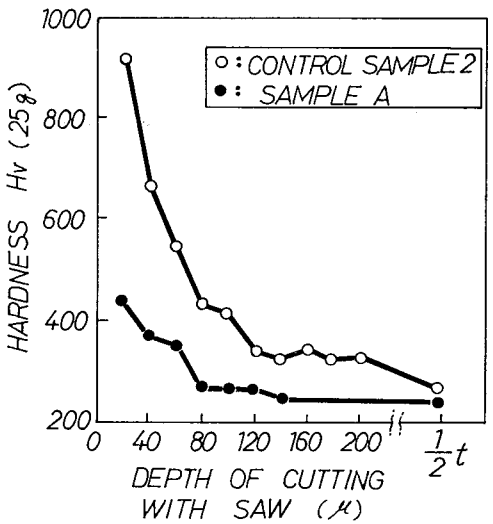
FIG. 6 is a graph showing the hardness distribution near the surface layer when cut with a saw.

FIG. 6 shows the hardness distribution near the surface layer when cut with a saw. In the control sample 2 containing carbon and manganese in amounts outside of the ranges of this invention, the hardness (Hv) reaches 900 due to precipitation of fine carbides and transformation to martensite. In contrast, in the sample A of the invention containing carbon and manganese in quantities in the specified ranges the hardness increases slighly near the surface layer due to work-hardening. The factors that degrade the machinability are the precipitation of fine carbides and transformation to martensite occuring during the cutting operation. Especially where the content of carbon is high, even though the austenite structure is stabilized to prevent transformation to martensite by increasing the content of manganese, the quantity of precipitated carbides increases thus imparing the machinability.

Where the machinability is important, incorporation of carbon in excess of the range specified in this invention should be avoided. For example, where it is desired to maintain the strength of the steel above a predetermined level there are many solutions including (1) to increase the content of carbon, (2) to decrease the rolling temperature and (3) to incorporate such strengthening elements as Cr, Si and V. However, the solution (1) should not be adopted for the reason described above, whereas the solution (2) should be adopted since it scarcely affect the machinability. Solution (3) can give satisfactory machinability so long as the essential conditions of this invention are satisfied. For this reason, if desired, 2% or less of chromium and 2% or less of vanadium may be incorporated. The limit of incorporation of these elements was determined because they are expensive and because incorporations of them beyond these limits does not result in any improvement of the characteristics. Moreover, where steel containing and excessive quantity of Cr or V are manufactured from a large ingot, segregation occurs.

As above described, according to this invention, the machinability of high manganese nonmagnetic steel can be greatly improved by clarifying the phenomena occuring at the time of machining and the factors that degrade the machinability. As a consequence, the nonmagnetic steel of this invention can be advantageously used in such various applications where strong magnetic field is created, and where large current is used as in railway vehicles or the like. Furthermore, since the nonmagnetic steel of this invention does not contain Pb and the sulphur content is low, the manufacturing of the same causes no harm to the public.

What we claim:

1. High manganese nonmagnetic steel having excellent machinability consisting essentially of 0.22–0.30% by weight of carbon, 22–28% by weight of manganese, up to 4% by weight of silicon, 0.030–0.10% by weight of sulphur, 0.001–0.008% by weight of calcium, 0.001–0.008% by weight of sol.Al and the balance of iron.

2. The high manganese nonmagnetic steel according to claim 1 which further contains either at least one of up to 2.0% by weight of chromium and up to 2.0% by weight of vanadium.

* * * * *